US006128450A

United States Patent [19]

Suetsugu

[11] Patent Number: 6,128,450

[45] Date of Patent: Oct. 3, 2000

[54] METHOD AND APPARATUS FOR DETECTING INK CONCENTRATION

[75] Inventor: Junichi Suetsugu, Niigata, Japan

[73] Assignee: NEC Corporation, Tokyo, Japan

[21] Appl. No.: 09/315,198

[22] Filed: May 19, 1999

[30] Foreign Application Priority Data

May 19, 1998 [JP] Japan ..... 10-153949

[51] Int. Cl.[7] ..... G03G 15/10

[52] U.S. Cl. ..... 399/58; 399/57

[58] Field of Search ..... 399/27, 29, 30, 399/57, 58, 61, 62, 98, 99, 237, 240, 241; 347/6, 7

[56] References Cited

U.S. PATENT DOCUMENTS

| | | | |
|---|---|---|---|
| 4,204,766 | 5/1980 | Harada | 399/57 X |
| 4,860,924 | 8/1989 | Simms et al. | 399/57 |
| 5,447,056 | 9/1995 | Foote | 399/57 X |
| 5,561,264 | 10/1996 | Iino et al. | 399/240 |
| 5,724,629 | 3/1998 | Iino et al. | 399/57 |
| 5,848,322 | 12/1998 | Chen et al. | 399/57 |

FOREIGN PATENT DOCUMENTS 3-295453 12/1991 Japan .

*Primary Examiner*—Sandra Brase

*Attorney, Agent, or Firm*—Ostrolenk, Faber, Gerb & Soffen, LLP

[57] ABSTRACT

A method for detecting the concentration of an ink liquid including charged particulates is disclosed. A first and a second electrodes are immersed in the ink liquid within an ink chamber. The second electrode is cleaned before a voltage pulse having a predetermined pulse width is applied to the first electrode. The voltage pulse causes a current flowing through the second electrode and a discharging current is detected. The concentration of the charged particulates in the ink liquid is detected from a peak value of the discharging current.

10 Claims, 2 Drawing Sheets

DETECTED CURRENT
I
0
TIME
201
202
$I_{PK}$

VOLTAGE PULSE
V
0
TIME

CLEANING TIMING
V
0
TIME
CLEANING
INK CONCENTRATION DETECTION PROCESS
CLEANING

METHOD AND APPARATUS FOR DETECTING INK CONCENTRATION

BACKGROUND OF THE INVENTION

1. Field of the Invention

The present invention relates to a method and an apparatus for detecting concentrations of liquid ink or a liquid developer including charged particulates such as toner.

2. Description of the Related Art

There has been proposed a toner concentration detection technique making use of electric conductivity of liquid developer in Japanese Patent Unexamined Publication No. 3-295453. The electric conductivity is measured using alternating current. The measurement frequency is determined depending on the frequency response of the object. In the case of liquid developer, a frequency of 1 kHz may be preferably used.

However, there occurs an increase in the number of ionic contaminants or the like due to deterioration of liquid developer. Such ionic contaminants or the like become a factor that substantially influences the measurement, resulting in a lower degree of measurement accuracy.

SUMMARY OF THE INVENTION

An object of the present invention is to provide a method and an apparatus which can detect ink concentrations with high accuracy.

Another object of the present invention is to provide a method and an apparatus which can detect ink concentrations using direct current with high accuracy and simplified structure.

According to the present invention, the concentration of an ink liquid including charged particulates is detected as follows: a) preparing a first electrode and a second electrode which are immersed in the ink liquid; b) cleaning the second electrode before applying a voltage pulse having a predetermined pulse width to the first electrode; c) detecting a current flowing through the second electrode, wherein the current is caused by the voltage pulse; and d) detecting concentration of the charged particulates in the ink liquid based on a magnitude of the current.

The current is a discharging current of the second electrode flowing in a direction opposite to a charging current caused by applying the voltage pulse to the first electrode. More specifically, a peak value of the current is detected which flows after the predetermined pulse width of the voltage pulse has elapsed. Then, the concentration of the charge particulates is detected from the peak value.

The concentration of an ink liquid can be detected by detecting the magnitude of a current flowing through the second electrode on which charged particulates have been deposited. More specifically, at the time when the voltage pulse rises, the charged particulates start moving toward the second electrode due to electrophorosis phenomenon and are deposited thereon. It is considered that a kind of capacitor is formed on the second electrode. Thereafter, when the voltage pulse falls, the formed capacitor starts discharging and thereby a current flow from the second electrode into the ink liquid. The magnitude of this discharge current is proportional to the thickness of the deposited charged particulates on the second electrode. Therefore, the ink concentration can be detected by detecting the magnitude of the discharge current.

According to the present invention, the second electrode is cleaned before the pulse voltage is applied to the first electrode and further the ink concentration is detected by detecting the magnitude of the discharge current. Therefore, the ink concentration can be obtained accurately. For example, the measurement of the toner concentration is unaffected by an increase in the number of ionized impurities or the like due to deterioration of the ink liquid.

Preferably, the second electrode is shaped like a cylinder and is cleaned by a cleaning roller. Since the cleaning step can be performed by only rotating the second electrode and the cleaning roller in opposite directions, the high efficiency of the cleaning can be achieved with simplified structure.

DETAILED DESCRIPTION OF THE PREFERRED EMBODIMENT

Figure 1:
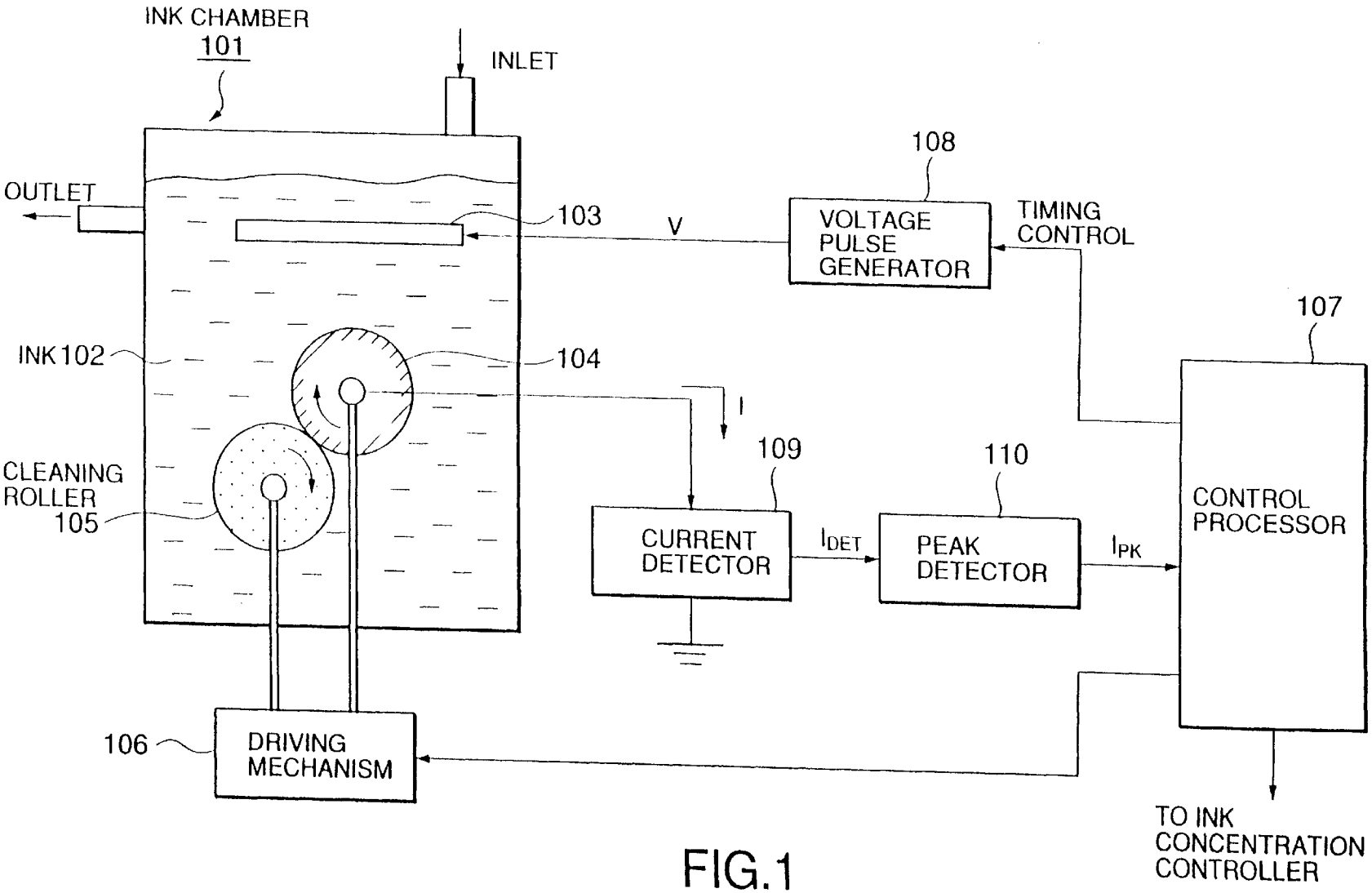
FIG. 1 is a diagram showing the construction of an ink concentration detecting apparatus according to an embodiment of the present invention.

Referring to FIG. 1, an ink chamber 101 stores maintained amounts of ink liquid 102 which is discharged through an outlet. The ink liquid 102 has charged particulates (here, toner particulates) included in a solution. The toner concentration of the ink liquid 102 is preferably kept constant to achieve the constant quality of printing. For this, the toner concentration is adjusted by supplying either a solution or toner condensate to the ink chamber 101 through an inlet.

Within the ink chamber 101, a plate electrode 103, a cylindrical electrode 104, and a cleaning roller 105 are provided in such a state that they are immersed in the ink liquid 102. The cylindrical electrode 104 is rotably placed at a predetermined distance from the plate electrode 103 such that the longitudinal axis of the cylindrical electrode 104 is parallel to the plate electrode 103. The cleaning roller 105 is also rotatably placed such that the longitudinal axis of the cleaning roller 105 is parallel to that of the cylindrical electrode 104 and the cleaning roller 105 makes sliding contact with the cylindrical electrode 104. The periphery of the cleaning roller 105 is formed like a brush to effectively remove deposited toner particulates from the cylindrical electrode 104. The brush may be made of an elastic material with the resistance to ink liquid such as nylon.

The cylindrical electrode 104 and the cleaning roller 105 are rotated in synchronization with each other in opposite directions by a driving mechanism 106 composed of a motor and gears (not shown) under control of a control processor 107. Therefore, a turn of the cylindrical electrode 104 causes the deposited toner particulates to be removed therefrom.

The plate electrode 103 is electrically connected to a voltage pulse generator 108. The voltage pulse generator 108 outputs a voltage pulse to the plate electrode 103 at timing controlled by the control processor 107. The cylindrical electrode 104 is electrically connected to a ground through a current detector 109. The current detector 109 detects a current flowing through the cylindrical electrode 104 to output a detected current $I_{DET}$ to a peak detector 110. The peak detector 110 detects the peak value of a discharge current from the detected current $I_{DET}$ under control of the control processor 107 and outputs a detected peak value $I_{PK}$ to the control processor 107.

Figures 2A, 2B, 2C:
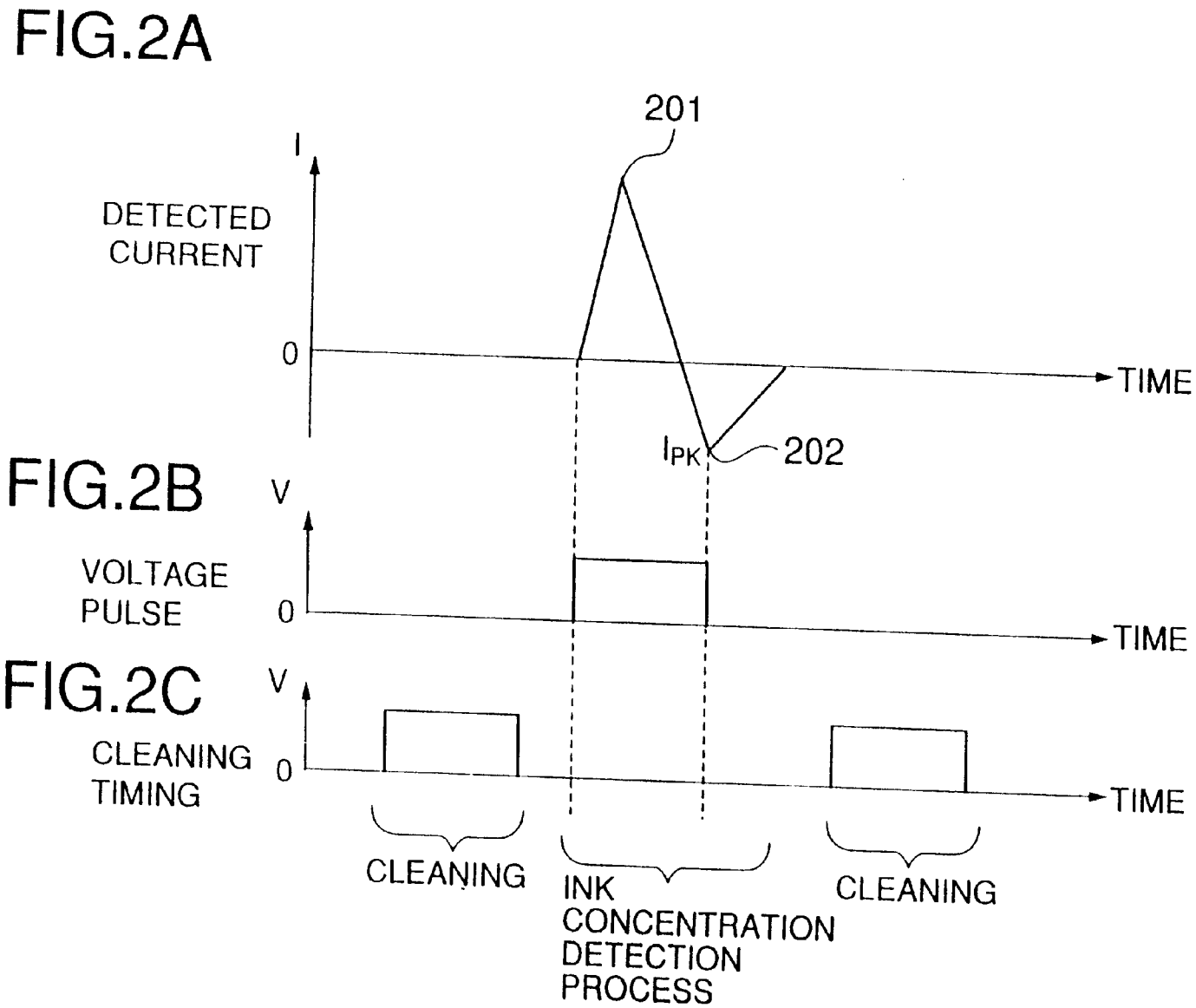
FIG. 2A is a diagram showing a waveform of a detected current caused by a voltage pulse in the embodiment.
FIG. 2B is a diagram showing the timing of the voltage pulse applied to the plate electrode in the embodiment.
FIG. 2C is a diagram showing the timing of cleaning the electrode roller in the embodiment.

Referring to FIGS. 2A–2C, the control processor 107 performs the cleaning of the cylindrical electrode 104 before the ink concentration detection. More specifically, when the ink concentration detection is going to be done, the control processor 107 drives the driving mechanism 106 to rotate the cylindrical electrode 104 for cleaning as shown in FIG. 2C.

After a turn of the cylindrical electrode 104 and the cleaning roller 105 has removed the deposited toner particulates from the surface of the cylindrical electrode 104, the control processor 107 controls the voltage pulse generator 108 so that a voltage pulse of a predetermined voltage V is output to the plate electrode 103 as shown in FIG. 2B.

When the voltage V is applied to the plate electrode 103, an electric field is generated between the plate electrode 103 and the cylindrical electrode 104 connected to the ground. The electric field causes charged particulates in the ink 102 to move toward the cylindrical electrode 104 due to the electrophorosis phenomenon. The drifting charged particulates include toner particulates, impurity particles, and condenser components of the solution. In this way, these charged particulates are moved and deposited on the cylindrical electrode 104 to form a kind of a capacitor thereon. The movement of the charged particulates produce a positive-direction current 201 flowing from the plate electrode 103 to the cylindrical electrode 104 and this positive-direction current 201 is detected by the current detector 109 as shown in FIG. 2A. In other words, the positive-direction current 201 is caused by not only the toner particulates but also the other particulates in the ink.

When the voltage pulse falls to the ground level, the toner particulates included in the formed capacitor starts discharging and thereby a negative-direction current 202 flows through the cylindrical electrode 104. The negative-direction current 202 is also detected by the current detector 109 as shown in FIG. 2A. Since the toner particulates predominantly causes the negative-direction current 202, the magnitude of the negative-direction current 202 is proportional to the thickness of the deposited toner particulates on the cylindrical electrode 104. Therefore, the toner concentration can be detected by detecting a peak value $I_{PK}$ of the negative-direction current 202.

The peak value $I_{PK}$ of the negative-direction current 202 is detected by the peak detector 110. By monitoring the peak value $I_{PK}$, the control processor 107 determines whether the toner concentration of the ink 102 falls out of a set range. If the toner concentration becomes diluted, the control processor 107 controls an ink concentration controller (not shown) so that the toner condensate is supplied to the ink chamber 101. Contrarily, if the toner concentration becomes dense, the control processor 107 controls the ink concentration controller so that the solution is supplied to the ink chamber 101. In this way, the toner concentration is kept constant.

In the above embodiment, the cleaning roller 105 is used to remove deposited particulates from the cylindrical electrode 104. However, another cleaning means is possible. For example, a cleaning blade making contact with the surface of the cylindrical electrode 104 may be employed. In this case, it is not necessary to move the cleaning blade.

An electrode connected to the current detector 109 may be preferably shaped like a cylinder as in the case of the cylindrical electrode 104. Another shape such as a plate may be possible.

What is claimed is:

1. A method, for detecting concentration of an ink liquid including charged particulates, comprising the steps of:

a) preparing a first electrode and a second electrode which are immersed in the ink liquid;

b) cleaning the second electrode before applying a voltage pulse having a predetermined pulse width to the first electrode, the voltage pulse causing a charging current between the first electrode and the second electrode;

c) detecting a discharging current of the second electrode flowing in a direction opposite to the charging current caused by applying the voltage pulse to the first electrode; and d) detecting concentration of the charged particulates in the ink liquid based on a magnitude of the discharging current.

2. The method according to claim 1, wherein in the step b), particulates deposited on a surface of the second electrode are removed by means of sliding contact.

3. The method according to claim 1, wherein the step b) comprises the steps of:

preparing a cleaning roller with making contact with the second electrode formed like a cylinder; and rotating the cleaning roller and the second electrode in opposite directions to clean a surface of the second electrode.

4. A method for detecting concentration of an ink liquid including charged particulates, comprising the steps of:

a) preparing a first electrode and a second electrode which are immersed in the ink liquid;

b) cleaning the second electrode before applying a voltage pulse having a predetermined pulse width to the first electrode;

c) detecting a current flowing through the second electrode, wherein the current is caused by the voltage pulse;

d) detecting a peak value of the current flowing after the predetermined pulse width of the voltage pulse has elapsed; and detecting the concentration of the charged particulates from the peak value.

5. The method according to claim 4, wherein the step b), particulates deposited on a surface of the second electrode are removed by means of sliding contact.

6. The method according to claim 4, wherein the step b) comprises the steps of:

preparing a cleaning roller with making contact with the second electrode formed like a cylinder; and rotating the cleaning roller and the second electrode in opposite directions to clean a surface of the second electrode.

7. An apparatus for detecting concentration of an ink liquid including charged particulates, the apparatus comprising:

an ink chamber storing the ink liquid;

a first electrode and a second electrode provided within the ink chamber such that they are immersed in the ink liquid;

a cleaner provided within the ink chamber, the cleaner cleaning the second electrode;

a pulse generator coupled to the first electrode, the pulse generator generating a voltage pulse having a predetermined pulse width which is applied to the first electrode;

a current detector coupled to the second electrode, the current detector detecting a current flowing through the second electrode, wherein the current is caused by the voltage pulse;

a peak detector coupled to the current detector, the peak detector detecting a peak value of the current flowing after the predetermined pulse width of the voltage pulse has elapsed, wherein the concentration of the charge particulates is detected from the peak value; and a controller coupled to the cleaner and coupled to the pulse generator, the controller controlling such that the cleaner cleans the second electrode before the voltage pulse is applied to the first electrode to produce the current.

8. The apparatus according to claim 7, wherein the cleaner is a cleaning roller which makes contact with the second electrode formed like a cylinder so that particulates deposited on a surface of the second electrode are removed by means of sliding contact.

9. The apparatus according to claim 8, further comprising a driving mechanism for rotating the cleaning roller and the second electrode is opposite directions to clean the surface of the second electrode.

10. The apparatus according to claim 9, wherein the controller controls such that the driving mechanism is driven for a predetermined time period before the pulse generator outputs the voltage pulse to the first electrode.

* * * * *